United States Patent [19]

Ford

[11] Patent Number: 4,978,094

[45] Date of Patent: Dec. 18, 1990

[54] BRACKET FOR CURTAIN RODS

[75] Inventor: Alan A. Ford, Sturgis, Mich.

[73] Assignee: Cooper Industries, Inc., Houston, Tex.

[21] Appl. No.: 436,907

[22] Filed: Nov. 15, 1989

[51] Int. Cl.[5] ..... A47H 1/10

[52] U.S. Cl. ..... 248/261; 160/201

[58] Field of Search ..... 248/261, 263, 265, 255, 248/256; 160/201

[56] References Cited

U.S. PATENT DOCUMENTS

| | | | |
|---|---|---|---|
| 762,733 | 6/1904 | Malmquist | 248/263 |
| 1,494,874 | 5/1924 | Wolff | 248/263 |
| 2,651,489 | 9/1953 | Bell | 248/265 |
| 2,944,782 | 7/1960 | Newcomb | 248/261 |
| 3,488,426 | 9/1969 | Loewy | 248/263 X |
| 3,857,538 | 12/1974 | Williamson | 248/263 |

FOREIGN PATENT DOCUMENTS

| | | | |
|---|---|---|---|
| 0143659 | 2/1931 | Switzerland | 248/256 |
| 0186177 | 9/1922 | United Kingdom | 248/265 |

*Primary Examiner*—Ramon O. Ramirez

*Attorney, Agent, or Firm*—Ned L. Conley; David A. Rose

[57] ABSTRACT

Disclosed is a base bracket able to hold multiple curtain rods or the like which generally requires only two screws to securely mount it to a wall or a solid support. The position of the base bracket is designed to be adjustable over a limited distance after mounting. The preferred base bracket includes multiple screw ports which run lengthwise along the base bracket. The screw slots preferably have a slit extending to the outer side of the bracket, to receive a mounted screw, or have an expanded portion which is large enough so that the head of a mounted screw can pass therethrough. The base bracket also includes a groove, preferably formed by a member extending from the upper surface of the base bracket. The groove can accommodate flanges attached to brackets on the curtain rods in order to hold them in place.

16 Claims, 2 Drawing Sheets

BRACKET FOR CURTAIN RODS

FIELD OF THE INVENTION

The invention relates to a base bracket for adjustably mounting a plurality of brackets for curtain rods or the like, which is easy to mount, can be readily adjusted upwardly or downwardly after mounting, and needs a minimal number of screws to hold it in place on a wall.

BACKGROUND OF THE INVENTION

Multiple curtain rods, (or similar means for mounting drapery) affixed in close proximity on a wall are desirable in a number of situations. One may wish to have a curtain which extends outwardly from and around the upper part of a conventional window blind, in order to hide the upper part of the blind and its support structure from view. Some valance, or "top treatment," designs may require from three to five rods, each with a separate bracket. Another situation where multiple curtain rods and mounting brackets are desirable is where an inner curtain, often made of a different material than an outer curtain, is desired. Both the inner and outer curtains will be supported by curtain rods with separate brackets which are spaced closely.

The primary problem with mounting multiple curtain rods is that the bracket supporting each end of each rod requires placing several screws in the wall to which the rod is mounted. The result is a multitude of screws in the wall, all in close proximity to each other. Because walls are usually made of plaster material such as GYROC TM, multiple screws can damage the walls by fragmenting the wall material. A related problem arises if the position of the rods needs to be changed after mounting to adjust the length of the curtain. This necessitates removal of screws from the wall and then reinsertion of the screws, leading to further weakening of the wall material. Thus, what is needed is a means for mounting multiple curtain rods to a wall which does not require a multitude of screws, and which can allow vertical adjustment of the position of each rod without remounting of the supporting screws.

Another problem associated with mounting curtain rods is that they must usually be held in place while the screws are being affixed to the wall. This makes mounting difficult. Mounting could be simplified if the screws could be affixed to the wall without the need to hold the curtain rods in place.

SUMMARY OF THE INVENTION

The invention includes a base bracket able to hold multiple brackets for curtain rods, or the like, which generally requires only two screws on each side to securely mount it to a wall or a solid support. Further, the base bracket need not be held in place while affixing the screws to the wall. The screws can be mounted to the wall before the bracket is affixed to the wall, and then tightened after the bracket is hung on the screws. Curtain rod brackets are vertically adjustable without the need for moving screws in the wall. In addition, the vertical position of the base bracket can be easily adjusted after mounting.

The preferred base bracket includes a longitudinal clamping groove which extends vertically when the base bracket is mounted on the wall, and in which curtain rod mounting brackets can be adjustably clamped. The groove can accommodate a plurality of tongues which extends from the curtain rod brackets, and includes clamping means which can lock to the tongues to hold the curtain rod bracket in place. Further features of the preferred curtain rod of the invention can be understood with reference to the figures and the drawings which follow.

DETAILED DESCRIPTION OF THE PREFERRED EMBODIMENTS

Figure 1:
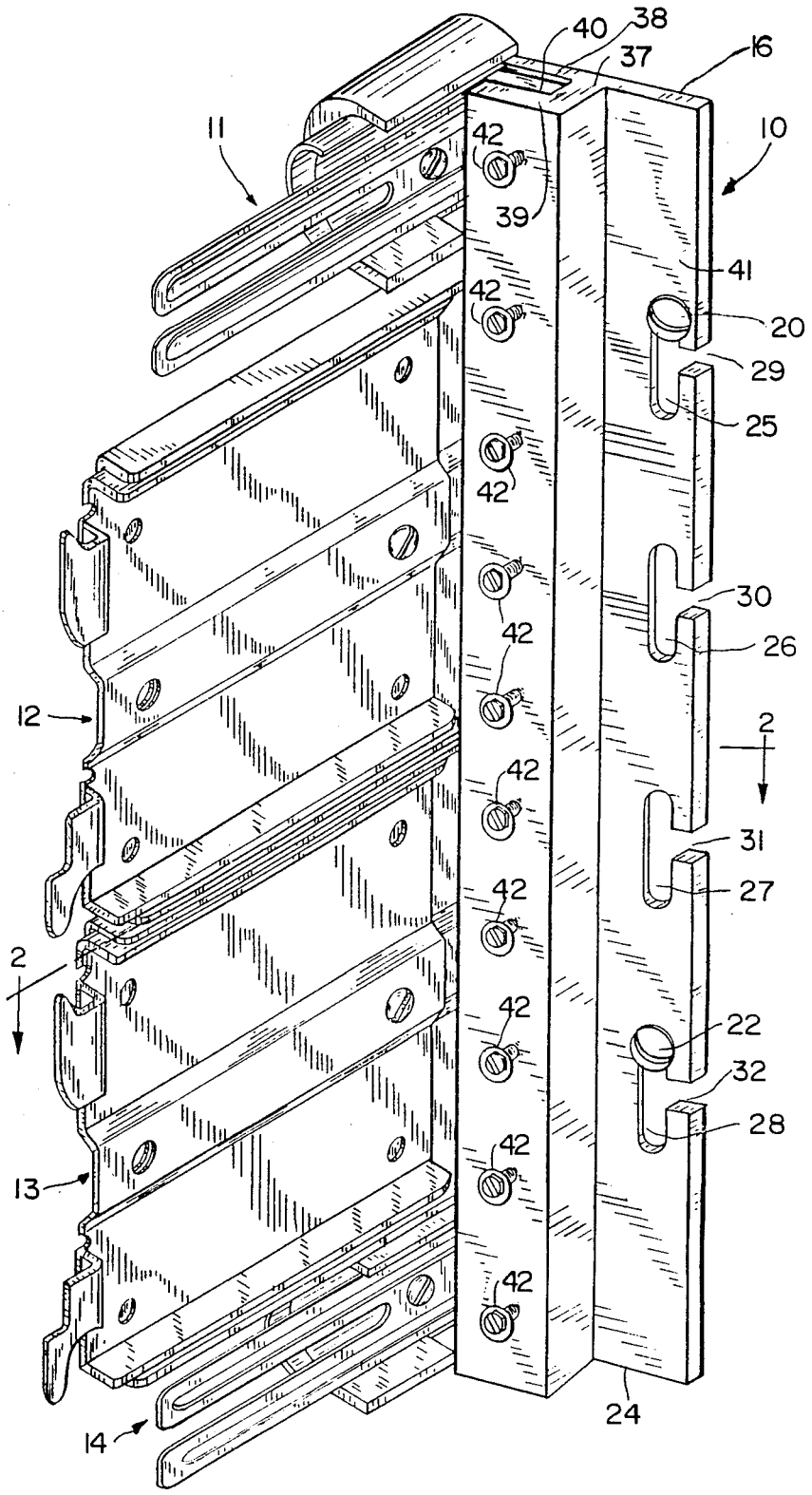
FIG. 1 is an isometric view from the upper left-hand side of a preferred base bracket of the invention mounted in place on a wall.

FIG. 1 of the drawing illustrates a single base bracket 10 having mounted thereon a plurality of curtain rod brackets 11, 12, 13, and 14, in vertical array. As shown, the base bracket comprises a vertically extending body 37 forming an "h" in cross-section. The two legs 38, 39 of the "h" form a longitudinally extending groove 40 therebetween, and a wall-engageable flange 41 is an extension of leg 38. Base bracket 10 is shown in the drawing at the left (facing the wall) end of the curtain support system, mounted on the wall 34, with its upper end 16 at the top of the drawing and its lower end 24 at the bottom of the drawing.

Figure 2:
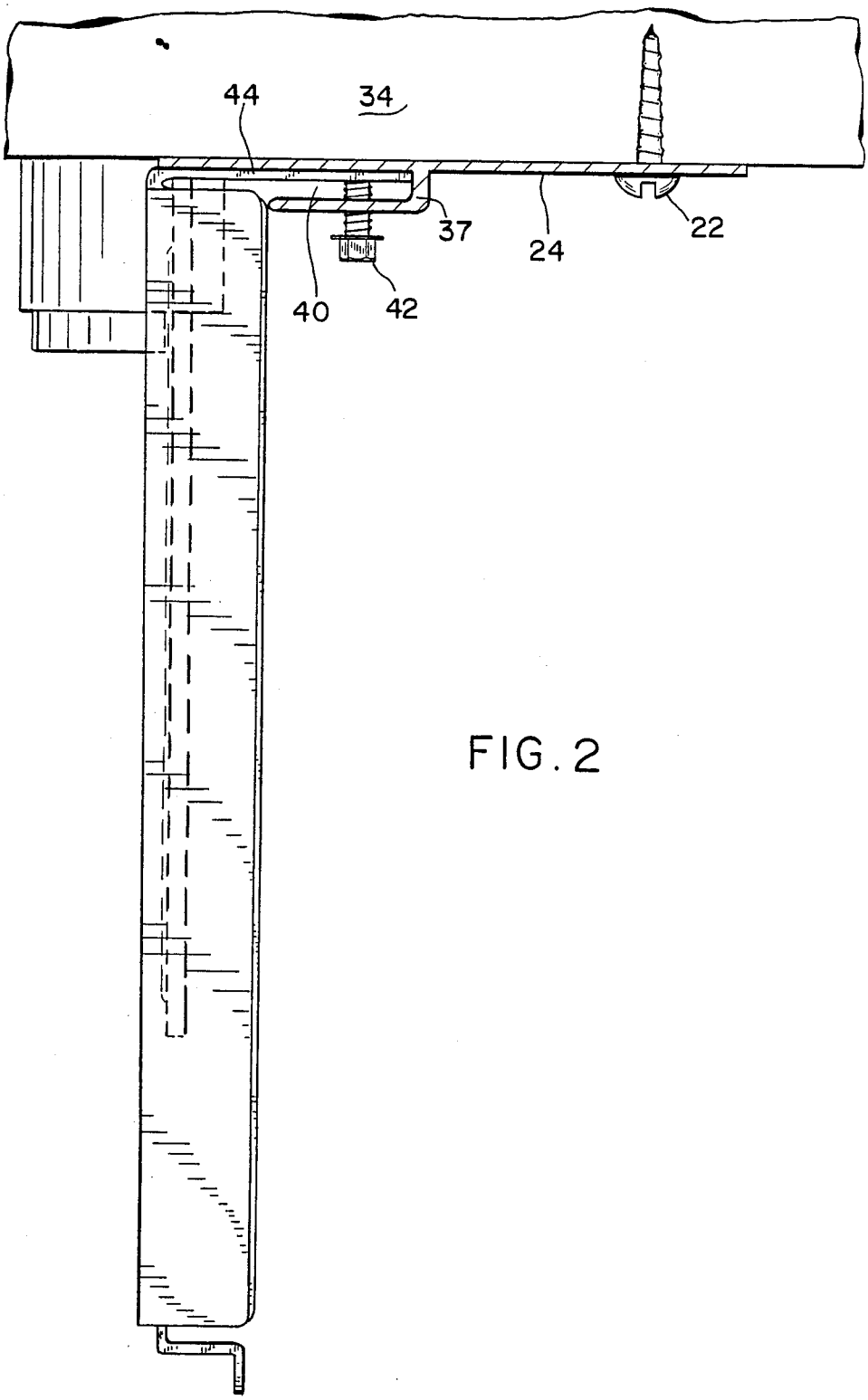
FIG. 2 is a sectional view of the base bracket of FIG. 1 taken along the lines 2—2.

Curtain rod brackets 11, 12, 13, and 14 are conventional structures, and are merely illustrative of the variety of brackets which are usable with the base bracket of the invention. Conventionally such rod brackets are provided with inturned flanges such as the flange 44 for mounting the bracket to the wall. According to this invention, the flanges 44 are inserted into the groove 40, and secured therein by one or more clamping set screws 42 which are threadedly received through leg 39 of the base bracket 10, and engage the flanges 44 within the groove 40, as shown in FIG. 2.

Flange 41 is provided with a plurality of screw slots, e.g., slots 25, 26, 27, and 28, each able to accommodate a mounting screw, e.g., screws 20 and 22. Provision may be made for the installation of a number of mounting screws, but usually only two screws will be required to support the curtain rod system. In the embodiment shown, an opening 29, 30, 31, 32 is formed in the middle of each screw slot to allow the flange 41 to be mounted on partially installed screws. Alternatively, each screw slot may be widened for a short portion of its length enough to pass a screw head.

Base bracket 10 can be of any length convenient or desirable. For example, it may be a strip of extruded aluminum, several feet long, and be cut to an appropriate length to hold the desired number of curtain rods. Screw slots 26, etc., and clamping screws 42 are spaced along the length of the strip, with spacing suitable for accommodating a variety of curtain rod brackets, so that when a base bracket is cut off, it will have the necessary screw slots and clamping screws.

The use of bracket 10 will now be described. First, the screws 20, 22 are attached to the wall 34. Thereafter, bracket 10 is hung on screws 20, 22 by passing the screws into slits 29, 32, respectively. Bracket 10 is then moved until the bodies of the screws, which are below the screw heads and have a smaller outside diameter, are positioned in the vertical portion of slots 25, 28. The position of bracket 10 can be adjusted to the limits of travel of the screws 20, 22 in the slots 25, 28. Typically, the length of the slots, and thus the potential adjustment of the position of bracket 10, is about one inch. Once the desired position of bracket 10 is reached, screws 20, 22 are tightened to lock it into place.

The curtain rod brackets, or other drapery hanging means, are attached to base bracket 10 as follows. As best seen in FIG. 2, flange 44 which is attached to members 11, 12, 13, 14, 15, 16 is inserted into groove 40. The screws 42 are then tightened against the surface of flange 44 to lock it in place, and thus support the curtain rod brackets. The curtain rod brackets may then be adjusted up and down by loosening the screws 42 and retightening them after the curtain rod bracket is moved to the desired location.

The curtain rod brackets held by the base bracket 10 can be any of a number of designs. For example, they can be the one-half cylindrical design of brackets 11 and 14, or the flange shape of brackets 12 and 13. The flange-shaped brackets can have flange-shaped extensions attached thereto, which can be covered with material to form a top treatment. A conventional curtain rod can be attached to the holders 11, 14.

It should be noted that the foregoing embodiments and the terms and expressions used to describe the invention are exemplary only and not limiting, and that the scope of protection is defined in the claims which follow and includes all equivalents of the subject matter of the claims.

What is claimed is:

1. A curtain rod support system comprising:

an elongate base bracket;

longitudinally extending flange means on said base bracket, having a surface adapted to engage a wall for attaching said base bracket to said wall;

a longitudinally extending groove in a surface of said base bracket which is perpendicular to the wall, said groove being parallel to said wall-engageable surface;

a plurality of curtain rod brackets;

an inturned mounting flange on each of said curtain rod brackets, each said mounting flange defining a right angle with the associated curtain rod bracket, and each mounting flange being received within a different longitudinal portion of said groove; and clamping means on said base bracket for clamping said mounting flanges in said base bracket.

2. A curtain rod support system as defined by claim 1 wherein said clamping means comprises a plurality of set screws spaced along the length of said base bracket, threadedly received in said base bracket and engaging said mounting flanges.

3. A base bracket for mounting a plurality of curtain rod brackets, comprising:

an elongate body;

a longitudinally extending flange on said body having a surface adapted to engage a wall for attaching said base bracket to said wall;

a longitudinally extending groove in a surface of said base bracket which is perpendicular to the wall, said groove being parallel to said wall-engageable surface; and a plurality of clamping members spaced longitudinally along said body adapted to clamp elements of curtain rod brackets in said groove, each said element defining a right angle with the associated curtain rod bracket.

4. A base bracket as defined by claim 3, wherein said clamping members comprise a plurality of set screws threadedly received in said base member and passing into said groove.

5. A base bracket as defined by claim 4, and including a plurality of screw holes spaced longitudinally along said longitudinally extending flange.

6. A base bracket to which one or more curtain rod brackets can be attached, said base bracket adapted for attachment to a solid support with screws, comprising:

a flat section having a plurality of slots, each slot having a first portion adapted to receive a screw after the screw has been affixed to the solid support, each slot further including a second portion adapted for receiving the screw following its entry into the first portion, whereby tightening the screw in the second portion affixes the base bracket to said solid support; means for mounting curtain rod holders to thereby affix the curtain rod holders to the base bracket; said means including a groove on the flat section adapted to receive a tongue on the curtain rods, whereby the tongue and the groove can lockingly mate.

7. The base bracket of claim 6 wherein said groove is formed by a first section perpendicular to said flat section, and a second section perpendicular to said first section and parallel to said flat section.

8. The base bracket of claim 7 wherein the second section includes a plurality of holes extending therethrough, each hole adapted for receiving screws which can be tightened against said tongue.

9. A base bracket to which one or more curtain rod brackets can be attached, said base bracket adapted for attachment to a solid support with screws, comprising:

a flat section having a plurality of slots, each slot having a first portion adapted to receive a screw after the screw has been affixed to the solid support, each slot further including a second portion adapted for receiving the screw following its entry into the first portion, whereby tightening the screw in the second portion affixes the base bracket to said solid support; means for mounting curtain rod holders to thereby affix the curtain rod holders to the base bracket; the first portion being a slit extending through the flat section which provides a connection from an edge of the flat section to said second portion.

10. A curtain rod support system comprising:

an elongate base bracket;

longitudinally extending flange means on said base bracket, having a surface adapted to engage a wall for attaching said base bracket to said wall;

a longitudinally extending groove in said base bracket, parallel to said wall-engageable surface;

a plurality of curtain rod brackets;

an inturned mounting flange on each of said curtain rod brackets, each said mounting flange being received within a different longitudinal portion of said groove; and clamping means on said base bracket for clamping said mounting flanges in said base bracket, said clamping means comprising a plurality of set screws spaced along the length of said base bracket, each screw being threadedly received in said base bracket and engaging said mounting flanges.

11. A base bracket for mounting a plurality of curtain rod brackets, comprising:

an elongate body;

a longitudinally extending flange on said body having a surface adapted to engage a wall for attaching said base bracket to said wall;

a longitudinally extending groove in said base bracket, parallel to said wall-engageable surface; and a plurality of clamping members spaced longitudinally along said body comprising a plurality of set screws threadedly received in said base member and passing into said groove, said clamping members adapted to clamp elements of curtain rod brackets in said groove.

12. The base bracket of claim 11 further including a plurality of screw holes spaced longitudinally along said longitudinally extending flange.

13. A base bracket to which one or more curtain rod brackets can be attached, said base bracket adapted for attachment to a solid support with screws, comprising:

a flat section having a plurality of slots, each slot having a first portion adapted to receive a screw after the screw has been affixed to the solid support, each slot further including a second portion adapted for receiving the screw following its entry into the first portion, whereby tightening the screw in the second portion affixes the base bracket to said solid support;

means for mounting curtain rod holders to thereby affix the curtain rod holders to the base bracket, wherein said means includes a groove on the flat section adapted to receive a tongue on the curtain rods, whereby the tongue and groove can lockingly mate.

14. The base bracket of claim 13 wherein said groove is formed by a first section perpendicular to said flat section, and a second section perpendicular to said first section and parallel to said flat section.

15. The base bracket of claim 14 wherein said second section includes a plurality of holes extending therethrough, each hole adapted for receiving screws which can be tightened against said tongue.

16. A base bracket to which one or more curtain rod brackets can be attached, said base bracket adapted for attachment to a solid support with screws, comprising:

a flat section having a plurality of slots, each slot having a slit portion adapted to receive a screw after the screw has been affixed to the solid support, each slot further including a second portion adapted for receiving the screw following its entry into the slit portion, each slit portion providing a connection from the edge of the flat section the second portion, whereby tightening the screw in the second portion affixes the base bracket to said solid support;

means for mounting curtain rod holders to thereby affix the curtain rod holders to the base bracket.

* * * * *